US011446676B2

(12) United States Patent
Pischon

(10) Patent No.: US 11,446,676 B2
(45) Date of Patent: Sep. 20, 2022

(54) SHREDDER DEVICE FOR SHREDDING MATERIAL

(71) Applicant: UNTHA shredding technology GmbH, Kuchl (AT)

(72) Inventor: Stefan Pischon, Kuchl (AT)

(73) Assignee: UNTHA SHREDDING TECHNOLOGY GMBH, Kuchl (AT)

( * ) Notice: Subject to any disclaimer, the term of this patent is extended or adjusted under 35 U.S.C. 154(b) by 162 days.

(21) Appl. No.: 16/794,352

(22) Filed: Feb. 19, 2020

(65) Prior Publication Data

US 2020/0179938 A1 Jun. 11, 2020

Related U.S. Application Data

(63) Continuation of application No. PCT/EP2018/072422, filed on Aug. 20, 2018.

(30) Foreign Application Priority Data

Aug. 23, 2017 (EP) ..... 17187514

(51) Int. Cl.
*B02C 25/00* (2006.01)
*B02C 18/22* (2006.01)
(Continued)

(52) U.S. Cl.
CPC ..... *B02C 18/2233* (2013.01); *B02C 18/14* (2013.01); *B02C 25/00* (2013.01); *B02C 2018/164* (2013.01); *B02C 2201/06* (2013.01)

(58) Field of Classification Search
CPC ..... B02C 25/00; B02C 18/2233; B02C 18/14; B02C 2018/2233
See application file for complete search history.

(56) References Cited

U.S. PATENT DOCUMENTS 4,061,280 A * 12/1977 Box ..... B02C 19/20 241/101.6
4,127,236 A * 11/1978 Lasar ..... B02C 18/144 241/280

(Continued)

FOREIGN PATENT DOCUMENTS

DE 20 2012 004 224 7/2012

OTHER PUBLICATIONS

English translation for DE202012004224 May 16, 2012.*
International Search Report dated Nov. 12, 2018 in International (PCT) Application No. PCT/EP2018/072422.

*Primary Examiner* — Faye Francis
(74) *Attorney, Agent, or Firm* — Wenderoth, Lind & Ponack, L.L.P.

(57) ABSTRACT

A shredder device for shredding materials, in particular recyclable material, waste wood and date storage devices, comprises a machine frame, at least one shredder rotor rotatably supported on the machine frame, and at least one feed device for conveying the material to be shredded to the at least one shredder rotor. At least one measuring device for continuously detecting a position of the at least one feed device, a control and/or regulating device for controlling and/or regulating a movement of the at least one feed device, and a signal transmitting device are provided. Measuring signals generated by the at least one measuring device can be supplied to the control and/or regulating device by the signal transmitting device.

24 Claims, 6 Drawing Sheets

(51) Int. Cl.
*B02C 18/14* (2006.01)
*B02C 18/16* (2006.01)

(56) References Cited

U.S. PATENT DOCUMENTS 4,394,984 A * 7/1983 Hight ..... B02C 18/143 241/278.1
4,423,844 A 1/1984 Sours et al.
4,655,403 A * 4/1987 Sciortino ..... F25C 5/12 241/278.1
5,209,413 A * 5/1993 Dwyer ..... A01F 29/005 241/101.76
5,379,955 A * 1/1995 McGraw ..... B02C 18/2291 241/186.2
5,417,374 A * 5/1995 Kranz ..... B02C 4/286 241/18
5,695,134 A * 12/1997 Williams ..... B02C 13/288 241/186.3
5,988,544 A * 11/1999 Williams, Jr. ..... B02C 18/146 241/294
6,016,979 A 1/2000 Squires et al.
6,405,949 B1 * 6/2002 Maguire ..... B02C 18/2291 241/30
7,905,437 B2 * 3/2011 Rota ..... B02C 18/2291 241/224
7,926,753 B2 * 4/2011 Carver ..... B02C 18/0007 241/99
8,733,682 B2 * 5/2014 Schiffer ..... B02C 18/2233 241/224
9,221,612 B2 * 12/2015 Strautmann ..... B65G 25/08
9,795,969 B2 * 10/2017 Lindner ..... B02C 18/16
9,968,939 B2 * 5/2018 Berglitsch ..... B02C 18/18
10,695,771 B2 * 6/2020 Friz ..... B02C 18/145
2007/0029418 A1 * 2/2007 Jakobi ..... B02C 19/0075 241/21
2011/0240775 A1 * 10/2011 Colombo ..... B02C 18/2233 241/30
2012/0018555 A1 * 1/2012 Schiffer ..... B02C 18/0084 241/101.2
2015/0060585 A1 * 3/2015 Fialho ..... B02C 18/02 241/265
2015/0129697 A1 * 5/2015 Berglitsch ..... B02C 18/2291 241/220
2015/0158030 A1 * 6/2015 Lindner ..... B02C 18/16 241/280
2016/0288133 A1 10/2016 Friz
2018/0214885 A1 * 8/2018 Garin Rotondaro .. C04B 18/021
2019/0054474 A1 * 2/2019 Pischon ..... B02C 18/2233
2020/0121823 A1 * 4/2020 Aner, Sr. ..... B09B 3/0083

* cited by examiner

SHREDDER DEVICE FOR SHREDDING MATERIAL

BACKGROUND OF THE INVENTION

The present invention relates to a shredder device for shredding material, in particular recyclable materials, waste wood and date storage devices, the shredder device comprising a machine frame, at least one shredder rotor rotatably supported on the machine frame, and at least one feed device for conveying the material to be shredded to the at least one shredder rotor. The invention further relates to processes for operating such a shredder device.

Shredder devices are already known from the prior art. It is frequently provided that the at least one feed device is configured to be movable between a first end position and a second end position. Thereby, an inductive sensor is arranged on both end positions, and the inductive sensor detects whether the feed device is located in one of the two end positions. If the feed device shall be moved into a certain position deviating from the end positions, then this is only possible by a switching interval, that is to say by an adjustable time in which the pusher is moved into a position which presumably corresponds to the desired position. The fact whether the feed device actually reaches the desired position cannot be controlled. That is a disadvantage, for example when the feed device is to be moved into a certain position for maintenance purposes. Also, the removal performance of the material cannot be detected. And eventually, malfunctions occurring between the two end positions can neither be detected by the control technology nor resolved. The malfunctions, for example, include a reduced throughput rate which can occur in connection with some materials to be shredded, or in the event of an inadequate cutting function of the cutting system, which is denoted colloquially as a so-called "free-cutting", that is to say cutting without substantial resistance. This free-cutting leads to an undesired heating of the shredder rotor, and/or the material to be shredded partially begins to melt, burn or char. There is a risk of fire for the end user. A further malfunction is that the feed device gets jammed.

It is to be noted that there are also shredding devices in which the at least one feed device is not movable between two end positions, but rather in a circle. The invention also relates to these shredding devices.

SUMMARY OF THE INVENTION

It is an object of the present invention to propose a shredder device which is improved over the prior art, which resolves at least partially, preferably entirely, the aforementioned problems, and which permits a complete controlling functionality of at least the movement of the at least one feed device. Further, an improved process for operating such a shredder device shall be proposed.

Regarding the shredder device, at least one measuring device for continuously detecting a position of the at least one feed device, a control and/or regulating device for controlling and/or regulating the movement of the at least one feed device, and a signal transmitting device are provided, and measuring signals generated by the at least one measuring device can be supplied to the control and/or regulating device by the signal transmitting device.

The term measuring device for continuously detecting a position of the at least one feed device is to be understood as a measuring device which is configured so as to continuously measure, thus on a multiplicity of subsequent locations, the position of the at least one feed device, in contrast to the prior art in which a measurement of the position of the at least one feed device is only possible on single locations.

By a continuous detection, it is possible that the position of the at least one feed device, in each position, can be clearly and reproducibly detected in terms of control and regulation. In addition, a detection of the at least one feed device at two end positions, as in the prior art, may, of course, also be provided, in particular in the case when the at least one feed device is configured to be movable between a first end position and a second end position, and the at least one measuring device is configured so as to continuously detect a position of the at least one feed device between the two end positions, as is provided in accordance with a preferred embodiment of the invention.

According to a preferred embodiment, at least one hydraulic piston-cylinder-device is provided for moving the at least one feed device. The at least one hydraulic piston-cylinder-device includes at least one inlet and at least one outlet for a hydraulic fluid, and the at least one measuring device for continuously detecting a position of the at least one feed device is configured to measure a volume flow of the hydraulic fluid in the inlet and/or in the outlet.

As an alternative or in addition, the at least one feed device may also be operated electrically or pneumatically.

Alternatively, the at least one measuring device for continuously detecting a position of the at least one feed device can be configured as a path measuring device. Preferably, the path measuring device includes a cable potentiometer.

The at least one measuring device for continuously detecting a position of the at least one feed device can be configured to measure a rotation angle of the at least one feed device. Preferably, the at least one measuring device includes a rotary encoder, and/or the at least one feed device is rotationally supported on the machine frame and the measuring device is configured to measure a rotation angle of the at least one feed device.

The measurement of a rotation angle does not necessarily mean that the at least one feed device is rotationally supported on the machine frame. For example, it is also possible that the at least one feed device is configured as a linear pusher configured to be driven by a chain, the chain being in engagement with a gear, and the rotation angle of the gear can be measured.

It is, of course, also possible to combine the three preferred possibilities for the configuration of the measuring device in any desired way in a shredder device, for example in order to increase the accuracy in detection of a position of the at least one feed device, or in order to provide a precaution in case that a measuring device fails.

With regard to the signal transmitting device provided according to the invention, it is further to be noted that the signal transmitting device can be based on each form of a physical data transmission, therefore also wirelessly for example.

The type and form of the at least one feed device is not crucial. It can be a feed device which is arranged in an arcuate configuration as well as a feed device arranged in a linear form.

The process according to the invention for operating a shredder device according to the invention includes the following process steps:

the at least one feed device is moved, preferably between a first end position and a second end position, the at least one measuring device generates measuring signals corresponding to the actual position of the at least one feed device, preferably between the two end positions, the measuring signals generated by the at least one measuring device are supplied to the control and/or regulating device by the signal transmitting device, and the actual position of the at least one feed device is determined by the control and/or regulating device based on the measuring signals.

In accordance with the three possibilities, mentioned in connection with the shredder device, for configuring the at least one measuring device, the following preferred embodiments can be provided, either individually or in combination with one another:

The at least one feed device is moved by at least one hydraulic piston-cylinder-device, the at least one hydraulic piston-cylinder-device being supplied via the at least one inlet and the at least one outlet with a hydraulic fluid, and the at least one measuring device measures a volume flow of the hydraulic fluid in the inlet and/or outlet.

The at least one measuring device measures a path covered by the at least one feed device, preferably relative to at least one end position.

The at least one measuring device measures a rotation angle. Preferably, the at least one measuring device is moved between two end positions, thereby performs a rotational movement and the at least one measuring device measures a rotation angle of the at least one feed device.

The detection of the position of the at least one feed device between the two end positions is the basis for a series of advantageous operating modes of the shredder device. For example, it is possible for the at least one feed device to be moved into an exactly predetermined position for maintenance purposes. In particular, this can be relevant when a maintenance flap is provided, and the at least one feed device has to adopt a given position relative to that maintenance flap, so that the maintenance flap can be opened at all or a given maintenance task can be performed.

Preferably, a speed of the at least one feed device can be detected by the control and/or regulating device based on the measurement signals generated by the at least one measuring device.

The speed of the at least one feed device, in turn, can further be used to determine a removal performance of the material.

It is also possible that the detected speed is compared to a reference speed. Preferably, for the case that the at least one feed device is moved by at least one hydraulic-cylinder-device, a deflection of a control slider is adapted upon a deviation of the detected speed from the reference speed.

In this connection, it is appropriate that a proportional valve for controlling the at least one feed device can be used for the machine hydraulics. By means of a proportional valve, there is the possibility to continuously control the speed of the at least one feed device between 0% and 100%. By measuring the actually occurring speed of the at least one feed device in relation to the speed theoretically predetermined by the valve, thus the reference speed, the same can be regulated. Therefore, when the theoretical speed is not reached, the control slider deflection can be altered until the theoretical speed conforms with the detected speed. By this regulation, the control slider is only deflected only as far as it is necessary for the material to be shredded. As a result, the absorbed power in the unit can be reduced and the oil warming can be decreased which, in turn, contributes to a decrease of the consumed power. With the current state of art, this is only possible with an increased effort. Here, the deflection of the control slider is performed with 100% of the maximum flow volume delivered by the hydraulic pump. Upon a deviation of the theoretical speed from the actual speed of the feed device, the excess volume of oil is returned to the tank again via a bypass and is introduced afresh into the cycle.

It has also been proven to be desirable that the speed is compared to at least one predefined threshold value. Preferably, the control or regulating device stops a movement of the at least one feed device upon reaching the at least one threshold value, or initiates a movement of the at least one feed device in the opposite direction, and/or starts a cleaning procedure for the at least one shredder rotor upon repeatedly reaching the threshold value. Preferably, the rotational direction of the at least one shredder rotor is reversed and the at least one feed device is pressed against the at least one shredder rotor.

For example, the predefined threshold value can be determined from the configuration of the cutting system, that is to say from the number of rows of blades, the maximum possible cut thickness and the prevailing rotational speed. From the mentioned parameters, it follows how much material can be removed per revolution or per time interval, respectively.

Through the measures mentioned above, the control and/or regulating device can actively counteract inefficiency of the cutting system and, in the event of a "free-cutting", an additional warming of the at least one shredder rotor can be prevented and the at least one feed device can be relieved.

As at the same time, if there is no change in the position of the at least one feed device or, respectively, the advance speed, the power consumption of drive motors, which are preferably provided, also decreases, it is appropriate for that parameter to be additionally used in order to detect a "free-cutting" situation.

The mentioned cleaning procedure can be advantageously performed in detail as described in the following: The cutting system is firstly deactivated, that is to say its power is cut off, and it comes to a halt. After stoppage, the rotational direction of the at least one shredder rotor is reversed, the at least one feed device moves in a rearward position, again fetches material and conveys the material actively in a direction of the at least one shredder rotor.

Due to the reversal of the rotational direction and the pressing process of the at least one feed device, the material adhering on the shredder rotor is moved into an undefined new position by the counter-rotation of the at least one shredder rotor. The duration of the rotor cleaning is dependent on the material and can be preferably adjusted by the control and/or regulating device. After the rotor cleaning has been finished, the cutting system is again stopped and after starting in the normal direction of rotation, the shredding process starts from the beginning. The automatic detection of inefficiency and the automatic initiation of the corrective measures are only made possible by the detection of the position or, respectively, advance detection action according to the invention.

It is appropriate for the cleaning procedure to be activated when the threshold value is reached x-times, and the number is preferably adjustable.

A further preferred operating mode is that the control and/or regulating device is configured to vary a position of an end position of the at least one feed device.

This means that, due to the detection of a position of the at least one feed device, there is the possibility to electronically limit a maximum possible stroke movement of the at least one feed device. If the at least one feed device, for example, provides a maximum possible stroke movement of approximately 1100 mm from the foremost to the rearmost end position, and material is shredded in the shredder device which does not require a stroke movement of 1100 mm, then the stroke movement can be reduced, for example to 50%, by electronic limitation. Thereby, the substantial control parameters remain unaffected. Due to the electronical limitation, the throughput rate can be increased, because the dead time for the unnecessary stroke movement is eliminated and the cycle time can be reduced. This makes it possible for the customer to react in a material-specific manner, without mechanical adjustment operations need to be performed at the shredder device, for example a time-consuming adjustment of sensors. That provides an increased throughput rate in relation to the lifetime of the shredder device.

A further preferred operating mode is that the control and/or regulating device determines a change of a path covered by the at least one feed device based on the measuring signals generated by the at least one measuring device. Preferably, a change of the path is compared to at least one predetermined threshold value, and, in the case the at least one threshold value is reached, the direction of movement of the at least one feed device is reversed.

In that way, for example, a jamming of the at least one feed device with material can be automatically detected at an early stage. If the at least one feed device is in its active operation, then a change in position is detected by the control and/or regulating device. If the value falls below a defined threshold value, and the motor current drops below a given threshold value, a free-cutting situation is present. An inward travel movement of the at least one feed device is automatically performed. If this also does not lead to a change in position or travel distance of the at least one feed device, then that is a clear indication that the at least one feed device is jammed. This automatic detection of a jam is not possible in the state of the art.

And eventually, it has been proven to be advantageous that the control and/or regulating device transmits a malfunction, detected by the control and/or regulating device based on the measuring signals generated by the at least one measuring device, to at least one indicator device. Preferably, the at least one indicator device includes a display screen. In this way, the malfunction can immediately be recognized by an end user.

In specific terms, it is appropriate, for example, that a transmittal to the at least one indicator device is to be effected when, after a cleaning procedure which has been activated several times for the at least one shredder rotor, no improvement in the advance of speed, or, respectively, the removal performance is found.

BRIEF DESCRIPTION OF THE DRAWINGS

Further details and advantages of the invention will be explained in the following description of figures with reference to the drawings, in which.

DETAILED DESCRIPTION OF THE INVENTION

Figure 1:
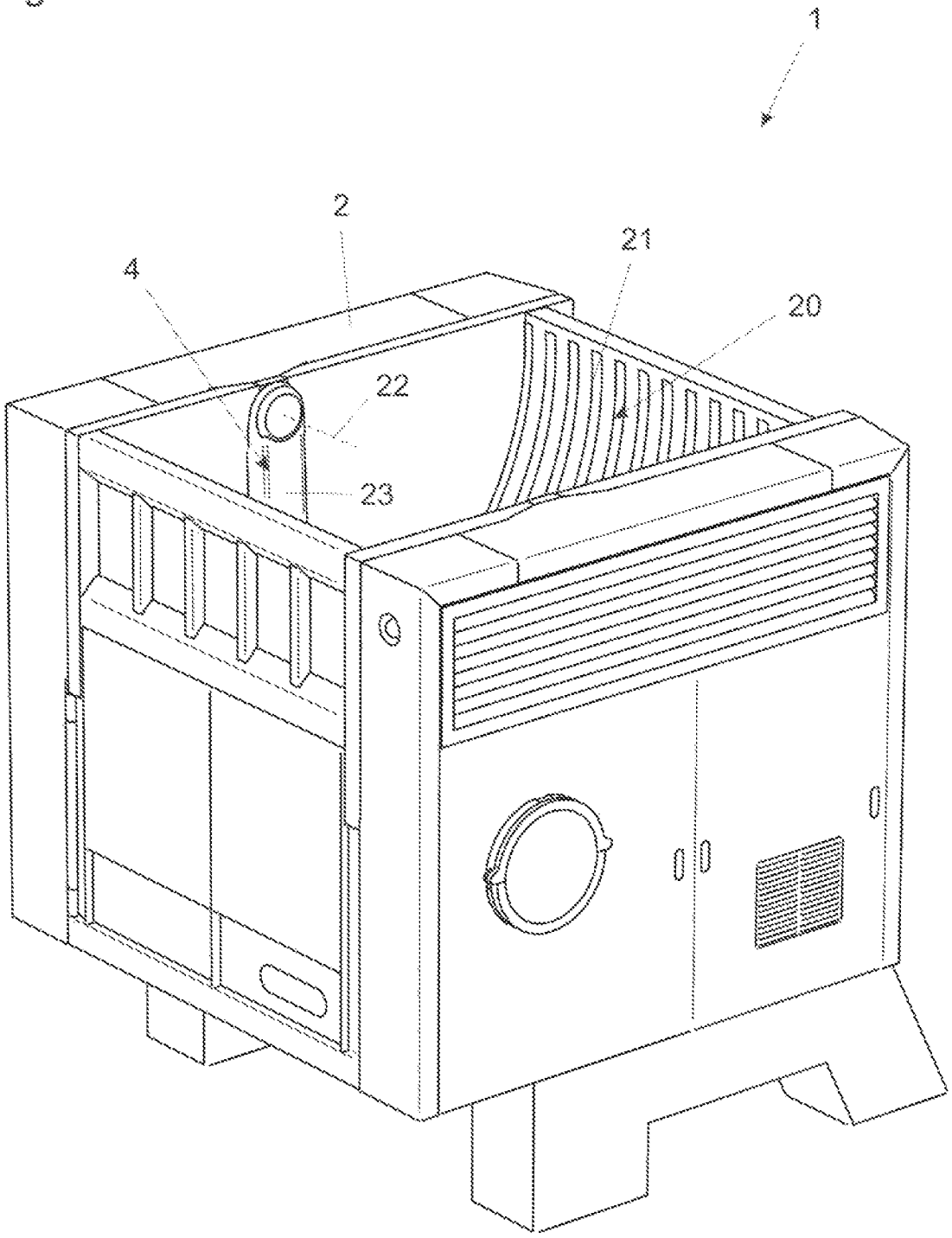
FIG. 1 shows a shredder device for shredding material in a schematic perspective view.

FIG. 1 shows a shredder device 1 having a machine frame 2. The machine frame 2 can include a basic framework, a support device for supporting the shredder device 1 on the ground, wall portions or claddings to the outside.

Material to be shredded is fed to the shredder device 1 by a material delivery chamber 20. In addition, a feed device 4 is rotationally supported about a rotational axis 22 on the sidewalls of the shredder device 1. The feed device 4 conveys the material to be shredded further to a shredder rotor 3 (cannot be seen in FIG. 1).

Figure 2:
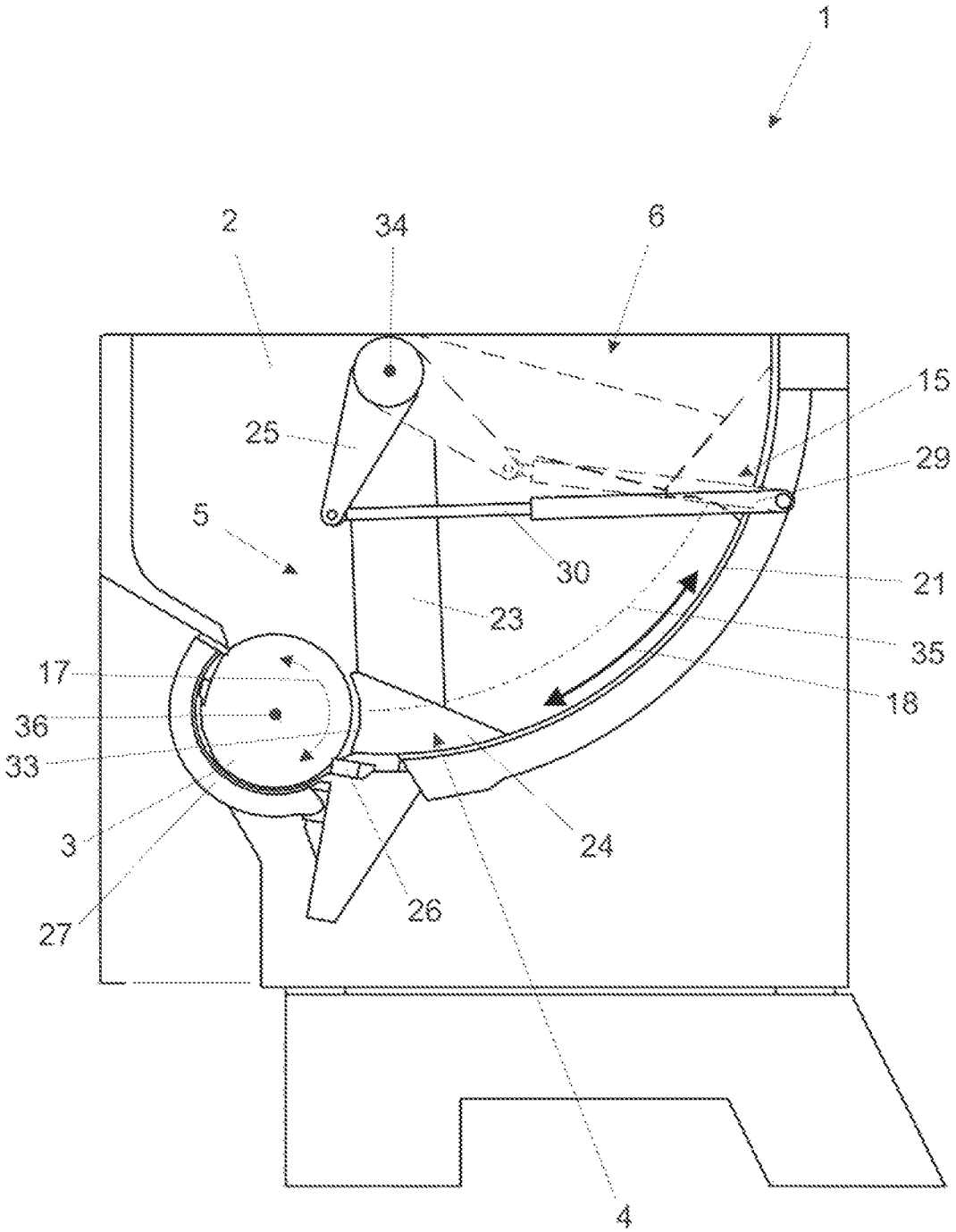
FIG. 2 is a cross-sectional view of the shredder device according to FIG. 1.

As can be seen from the sectional view according to FIG. 2, the feed device 4 includes a pusher 24 having a pushing surface 33. For example, the pusher 24 can be configured so as to be substantially wedge-shaped in a cross-section. The pusher 24 is connected to a pivot point 34 by two levers 23 spaced from one another.

Instead of such a pivotable feed device 4, a linearly displaceable feed device may also be employed.

The pusher 24 or, respectively, the feed device 4 moves along a wall portion 21, namely between a first end position 5 and a second end position 6. The first end position 5 is arranged adjacent to a shredder rotor 3 and the second end position 6 is spaced therefrom. Thereby, the pusher 24 or, respectively, the feed device 4 can assume any position between these two end positions 5 and 6. The positions through which the device passes in that case are indicated by a dash-dotted line 35. In order to move the pusher 24 or, respectively, the feed device 4 from the first position 5 into the second end position 6, the pusher 24 rotates about the pivot point 34 in an anticlockwise direction, in the view shown in FIG. 2. The reverse movement takes place in the clockwise direction. The directions of movement of the pusher 24 or, respectively, the feed device 4 are indicated by a double-headed arrow 18.

The feed device 4 is driven by two hydraulic piston-cylinder-devices 15, each having a cylinder 29 and a piston movable therein, the piston having a piston rod 30. In the illustrated case, the cylinder 29 is arranged on the machine frame 2. The piston rod 30 is hingedly connected to the lever arm 23 via an intermediate lever 25. Of course, a reversed configuration may also be used, in which the piston rod 30 is arranged on the machine frame 2 and the cylinder 29 acts on the intermediate lever 25.

The piston-cylinder-device 15 and the intermediate lever 25 are each arranged in a sidewall of the shredder device 1. The intermediate lever 25 is connected to the lever arm 23 in a torque-proof manner.

The material conveyed by the feed device 4 to the shredder rotor 3 is shredded by cutting devices arranged at a periphery of the shredder rotor 3 and stationary counterpart blades 26, more specifically until the material is at a given degree of shredding which is adjustable by a sieve device 27.

Via the sieve device 27, the shredded material reaches to the outside and can be carried away, for example by conveyor belts.

The shredder rotor 3 is rotationally supported about a pivot point 36 on the machine frame 2. The directions of rotation are denoted with the reference number 17 and with a double-headed arrow.

Figure 3:
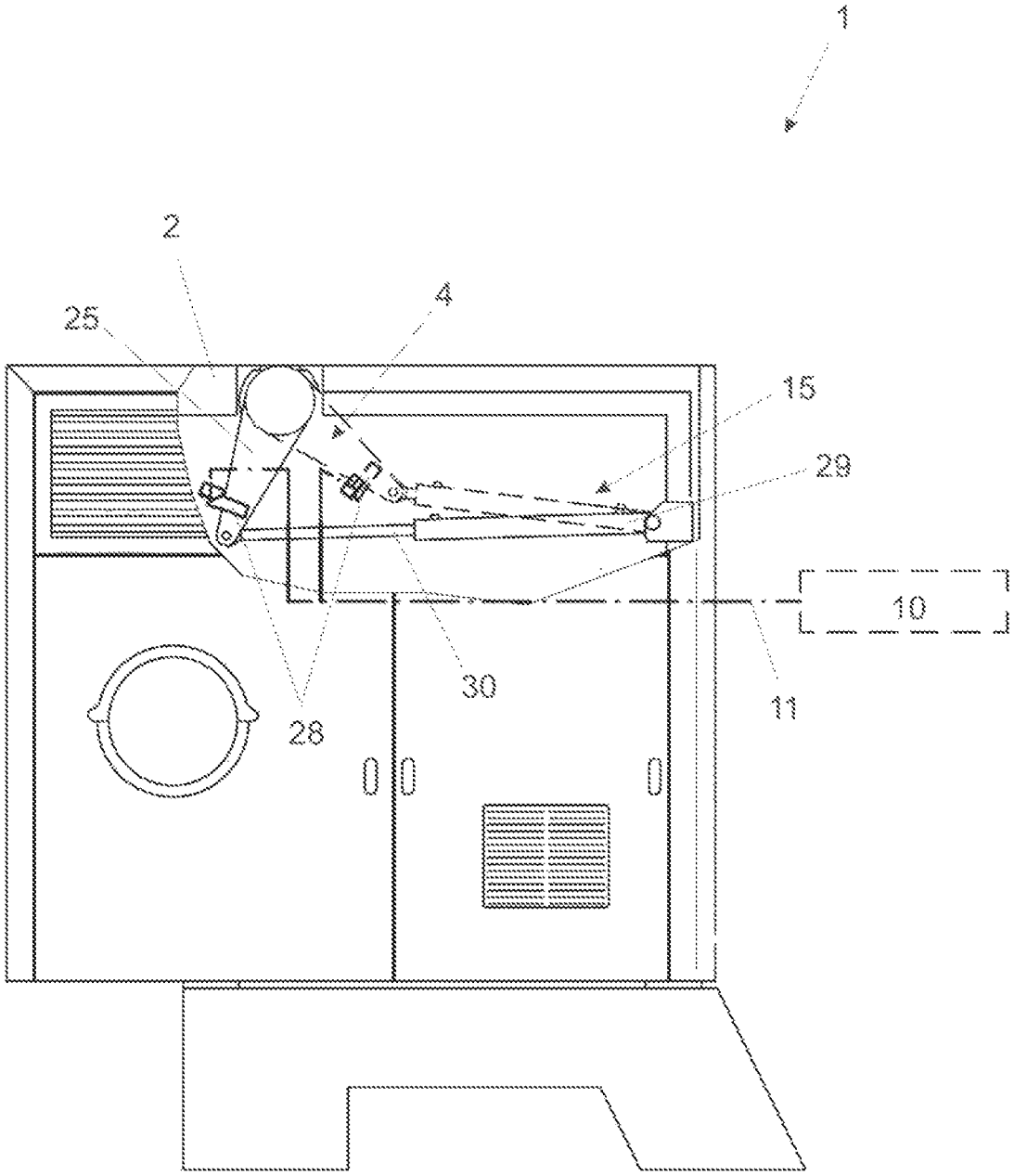
Fig. 3 (PRIOR ART)
FIG. 3 is a side view of a shredder device according to the prior art, with a part of the side cover having been omitted in this view.

As already stated in the opening part of this specification and as shown in FIG. 3, the prior art provides that the presence of the feed device 4 can be detected in one of the two end positions 5 and 6 by two stationary sensors 28 which can be in the form of inductive sensors. The sensors 28 are connected to a control and/or regulating device 10 by a signal transmitting device 11. The position of the at least one feed device 4 between these two end positions 5 and 6 cannot be detected. The disadvantages connected therewith have been explained in detail hereinbefore. It is not excluded that such sensors can also be employed with the present invention.

Figure 4:
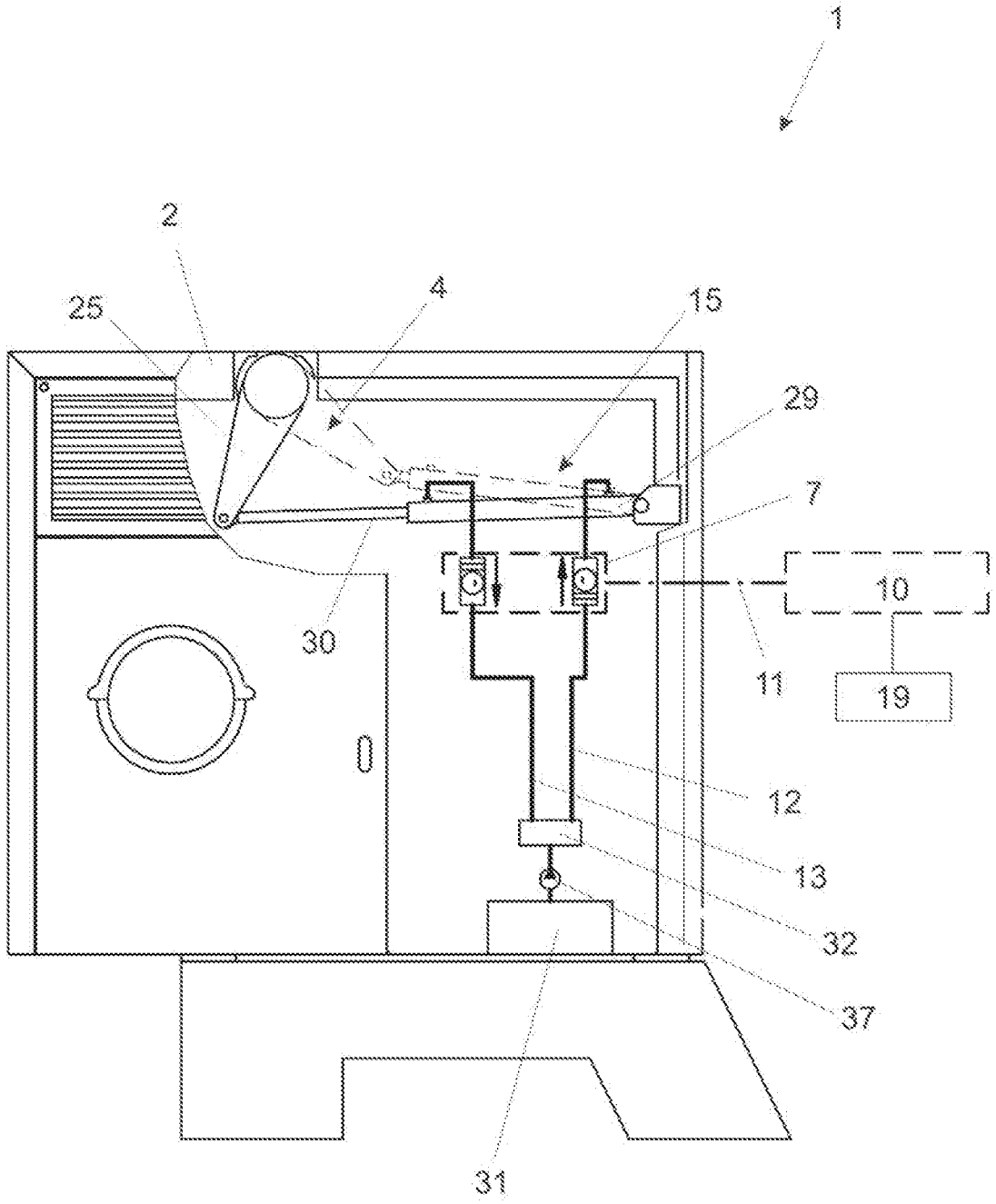
FIG. 4 is a side view of a shredder device according to the invention in a first preferred embodiment, with a part of the side cover having been omitted in this view.

FIG. 4 shows a first preferred embodiment of the shredder device 1 or, respectively, the process for operating the shredder device 1. Thereby, the supply of the hydraulic piston-cylinder-device 15 is effected by a hydraulic fluid via an inlet 12 and an outlet 13. The hydraulic fluid can be stored in a tank 31 which communicates with the inlet 12 and the outlet 13 by a pump 37 and a proportional valve 32. There is now provided a measuring device 7, the measuring device 7 being configured to measure a volume flow of the hydraulic fluid in the inlet 12 and in the outlet 13. The measuring signals are forwarded to the control and/or regulating device 10 by a signal transmitting device 11. In the control and/or regulating device 10, the position of the feed device 4 between the two end positions 5 and 6 is continuously detected based on the provided measuring signals.

Figure 5:
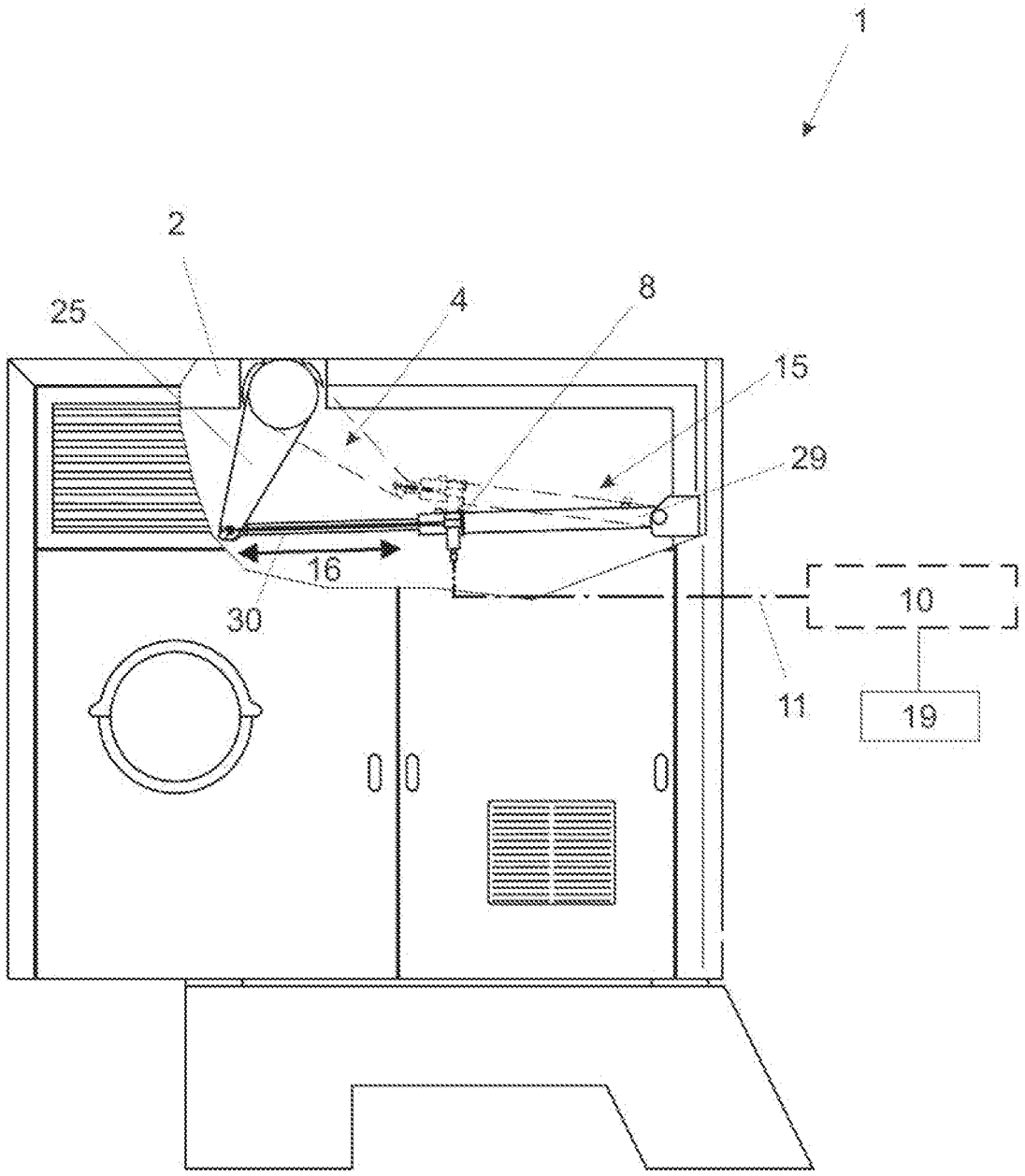
FIG. 5 is a side view of a shredder device according to the invention in a second preferred embodiment, with a part of the side cover having been omitted in this view.

FIG. 5 shows a second preferred embodiment of the shredder device 1 or, respectively, the process for operating the shredder device 1. Thereby, a path measuring device 8 is employed, the path measuring device 8 including a cable potentiometer in the depicted case. With this path measuring device 8, a path 16 covered by the feed device 4 relative to the end positions 5 and 6 can be measured. The measuring signals are forwarded to the control and/or regulating device 10 by a signal transmitting device 11. In the control and/or regulating device 10, the position of the feed device 4 relative to the two end positions 5 and 6 can be continuously detected based on the provided measuring signals.

Figure 6:
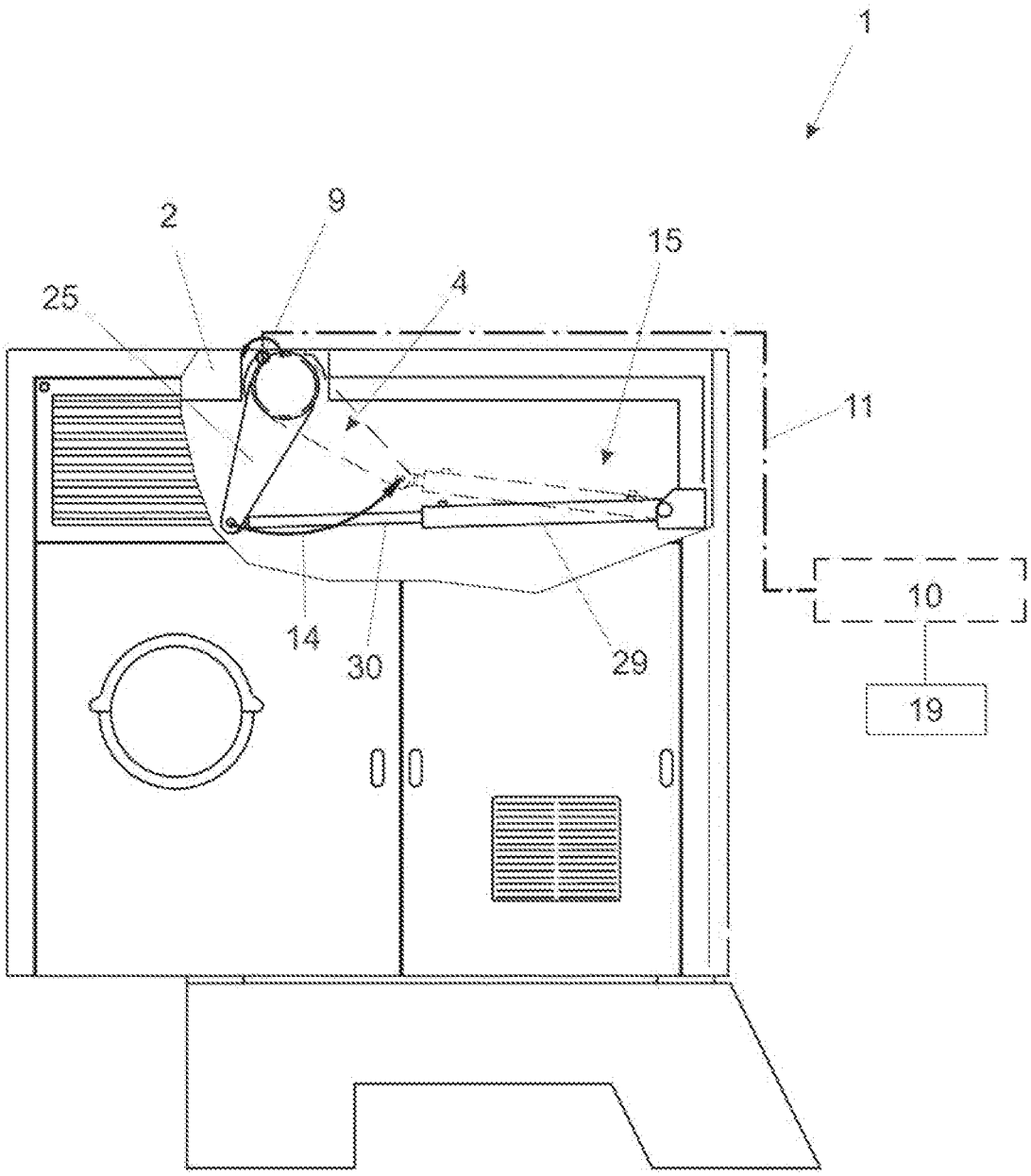
FIG. 6 is a side view of a shredder device according to the invention in a third preferred embodiment, with a part of the side cover having been omitted in this view.

FIG. 6 shows a third preferred embodiment of the shredder device 1 or, respectively, the process for operating the shredder device 1. Thereby, a measuring device 9 is employed, the measuring device 9 being configured to measure a rotational angle 14 of the feed device 4, and the measuring device 9 includes a rotary encoder. The measuring signals are forwarded to the control and/or regulating device 10 by a signal transmitting device 11. In the control and/or regulating device 10, the position of the feed device 4 between the two end positions 5 and 6 can be continuously determined based on the provided measuring signals.

The position of the feed device 4 determined thereby serves as a starting point for the advantageous embodiments described hereinbefore of the process for operating the shredder device 1.

The control and/or regulating device 10 can be connected in a signal-conducting manner to an indicator device 19 in order to provide information to a user of the shredder device 1, for example about malfunctions which cannot be automatically resolved.

It is not necessary to arrange the measuring devices 28, 7, 8 and 9 indicated in the figures on the depicted locations of the feed device 4. Any appropriate location can be used here. It is also not mandatory that the measuring devices 28, 7, 8 and 9 are directly coupled to the at least one feed device 4. For example, an arrangement in a wall, along which the at least one feed device 4 moves, is also possible. A configuration in the form of a magneto-resistive sensor can be used here.

The invention claimed is:

1. A shredder device for shredding material, the shredder device comprising:

a machine frame;

a shredder rotor rotatably supported on the machine frame;

a feed device for conveying the material to be shredded to the shredder rotor; and a material delivery chamber for supplying the material to be shredded to the shredder device, wherein the feed device is rotationally supported about a rotational axis, the feed device being configured to further convey the material to be shredded to the shredder rotor by a rotational movement about the rotational axis, wherein a measuring device for continuously detecting a position of the feed device, a control and/or regulating device for controlling and/or regulating a movement of the feed device, and a signal transmitting device are provided, and wherein the signal transmitting device is configured such that measuring signals of the continuously detected position of the feed device generated by the measuring device are supplied to the control and/or regulating device by the signal transmitting device, whereby a speed of the feed device is determined on a basis of the continuously detected position of the feed device.

2. The shredder device according to claim 1, wherein the feed device is configured to be moved between a first end position and a second end position, the measuring device being configured to continuously detect a position of the feed device between the first and second end positions.

3. The shredder device according to claim 1, wherein a hydraulic cylinder-piston-device for moving the feed device is provided, the cylinder-piston-device including an inlet and an outlet for a hydraulic fluid, and the measuring device is configured to measure a volume flow of the hydraulic fluid in the inlet and/or in the outlet.

4. The shredder device according to claim 1, wherein the measuring device for continuously detecting a position of the feed device is configured as a path measuring device.

5. The shredder device according to claim 4, wherein the path measuring device includes a cable potentiometer.

6. The shredder device according to claim 1, wherein the measuring device for continuously detecting a position of the feed device is configured to measure a rotation angle.

7. The shredder device according to claim 6, wherein the measuring device includes a rotary encoder, or the feed device is rotationally supported on the machine frame and the measuring device is configured to measure a rotational angle of the feed device.

8. The shredder device according to claim 1, wherein the material to be shredded is at least one of recyclable materials, waste wood and date storage devices.

9. The shredder device according to claim 1, wherein the feed device is rotationally supported about the rotational axis on sidewalls of the shredder device.

10. A process of operating a shredder device for shredding material, comprising Providing a machine frame, a shredder rotor rotatably supported on the machine frame, and a feed device for conveying the material to be shredded to the shredder rotor, wherein a measuring device for continuously detecting a position of the feed device, a control and/or regulating device for controlling and/or regulating a movement of the feed device, and a signal transmitting device are provided, and wherein the signal transmitting device is configured such that measuring signals generated by the measuring device are supplied to the control and/or regulating device by the signal transmitting device, device;

moving the feed device;

generating measuring signals with the measuring device, the measuring signals corresponding to an actual position of the feed device;

supplying the measuring signals generated by the measuring device to the control and/or regulating device by the signal transmitting device, and determining the actual position of the feed device by the control and/or regulating device based on the measuring signals, wherein the process further comprises determining a speed of the feed device by the control and/or regulating device based on the continuously detected position of the feed device via the measuring signals generated by the measuring device.

11. The process according to claim 10, wherein the feed device is moved by a hydraulic piston-cylinder-device, the hydraulic piston-cylinder-device being supplied with a hydraulic fluid via an inlet and an outlet, and the measuring device measures a volume flow of the hydraulic fluid in the inlet and/or in the outlet.

12. The process according to claim 10, wherein the measuring device measures a path covered by the feed device.

13. The process according to claim 12, wherein the measuring device measures the path covered by the feed device relative to at least one of the first and second end positions.

14. The process according to claim 10, wherein the measuring device measures a rotational angle of the feed device.

15. The process according to claim 14, wherein the feed device is moved between the first and second end positions and performs a rotational movement, and the measuring device measures the rotational angle of the feed device.

16. The process according to claim 10, wherein the process further comprises determining a removal performance of the material from the determined speed.

17. The process according to claim 10, wherein the process further comprises comparing the determined speed to a reference speed.

18. The process according to claim 17, wherein the feed device is moved by a hydraulic piston-cylinder-device, and a deflection of a control slider is adapted upon a deviation of the detected speed from the reference speed.

19. The process according to claim 10, wherein the process further comprises comparing the determined speed to a predetermined threshold value, and wherein the control and/or regulating device performs at least one of stopping a movement of the feed device upon reaching the predetermined threshold value, or initiating a movement of the feed device in an opposite direction, and starting a cleaning procedure for the shredder rotor upon repeatedly reaching the predetermined threshold value.

20. The process according to claim 19, wherein the control and/or regulating device performs the starting of the cleaning procedure for the shredder rotor upon repeatedly reaching the predetermined threshold value, and a rotational direction of the shredder rotor is reversed and the feed device is pressed against the shredder rotor.

21. The process according to claim 10, wherein the control and/or regulating device transmits a malfunction detected by the control and/or regulating device based on the measuring signals generated by the measuring device to an indicator device.

22. The process according to claim 21, wherein the indicator device includes a display screen.

23. The process according to claim 10, wherein the moving of the feed device includes moving the feed device between the first end position and the second end position, and wherein measuring signals generated by the measuring device correspond to the actual position of the feed device between the first and second end positions.

24. A process of operating a shredder device for shredding material, the shredder device comprising a machine frame, a shredder rotor rotatably supported on the machine frame, and a feed device for conveying the material to be shredded to the shredder rotor, wherein a measuring device for continuously detecting a position of the feed device, a control and/or regulating device for controlling and/or regulating a movement of the feed device, and a signal transmitting device are provided, and wherein the signal transmitting device is configured such that measuring signals generated by the measuring device are supplied to the control and/or regulating device by the signal transmitting device, the process comprising:

moving the feed device;

generating measuring signals with the measuring device, the measuring signals corresponding to an actual position of the feed device;

supplying the measuring signals generated by the measuring device to the control and/or regulating device by the signal transmitting device, and determining the actual position of the feed device by the control and/or regulating device based on the measuring signals, wherein the process further comprises determining, by the control and/or regulating device, a change of a path covered by the feed device based on the measuring signals generated by the measuring device, and comparing the change of the path to a predetermined threshold value and, upon reaching the predetermined threshold value, reversing a movement direction of the feed device.

* * * * *